US006307185B1

(12) United States Patent
Loveless

(10) Patent No.: US 6,307,185 B1
(45) Date of Patent: Oct. 23, 2001

(54) THERMALLY EFFICIENT PORTABLE CONVECTIVE OVEN

(76) Inventor: Jerry Loveless, 10008 114th St., SW., Lakewood, WA (US) 98048

( * ) Notice: Subject to any disclaimer, the term of this patent is extended or adjusted under 35 U.S.C. 154(b) by 0 days.

(21) Appl. No.: 09/723,055

(22) Filed: Nov. 27, 2000

(51) Int. Cl.[7] ..... A21B 1/14; A21B 1/22; A21B 1/26; F24C 15/34

(52) U.S. Cl. ..... 219/400; 219/399; 219/405; 219/413

(58) Field of Search ..... 219/391, 395, 219/396, 398, 400, 405, 413; 99/474, 476; 126/21 A

(56) References Cited

U.S. PATENT DOCUMENTS 4,942,288 * 7/1990 Worsham et al. ..... 219/399
5,605,092 * 2/1997 Riccio ..... 99/447
5,665,259 * 9/1997 Westerberg ..... 219/411
5,676,870 * 10/1997 Wassman et al. ..... 219/400
5,693,242 * 12/1997 Sanchez ..... 219/400
5,695,668 * 12/1997 Boddy ..... 219/400
6,114,663 * 9/2000 Stockley ..... 219/398

* cited by examiner

*Primary Examiner*—Joseph Pelham

(57) ABSTRACT

A thermally efficient, low voltage, portable convection/conduction cooking oven that is an improvement of combination conduction/convection ovens, portable or permanently affixed in place. The oven contains a low thermal mass conductive cooking slab 6 heated by lower elements 17. The oven utilizes convective cooking by moving air with fan 10 across upper elements 9. The oven successfully utilizes 110-volt service, energizing upper elements 9 and lower elements 17 with a cumulative draw of no more than 1550 watts and 13.5 steady state amps while cooking foods in one fourth to one third the time of conventional ovens. The low thermal mass conductive cooking slab temperature is maintained optimally stable by means of lower heating elements 17 remaining energized throughout the conductive cooking process. The oven utilizes a unique grouping of thermally efficient improvements. These improvements produce in synergy a low profile, lightweight oven with exceptional preheating times, cooking limes and end product food quality.

30 Claims, 2 Drawing Sheets

THERMALLY EFFICIENT PORTABLE CONVECTIVE OVEN

FIELD OF INVENTION

This invention relates to portable pizza type ovens, more particularly as an improvement of combination conduction/convection ovens, portable or permanently affixed in place.

BACKGROUND OF THE INVENTION

Baking ovens are a very old art as are the more recent ovens using convection and/or conductive cooking surfaces upon which baked goods may be produced with reduced cooking time. Of particular focus within the art is the use a variety of cooking cycles in order to provide greater versatility and improved cooking performance. One common reason for varying cooking cycles was to utilize 110-volt service using elements whose wattage was the UL limit for a 110-volt service. That limit is to have no more than 13.5 steady state amperage draw and a total of 1550 watts. The UL wattage limits for 110-volt ovens, mandated an alternating cycle between upper and lower elements using full 13.5 amp cumulative capacity elements both top and bottom. The desire to provide a 110-volt cooking oven that could be plugged into a common household outlet combined with the need for higher wattage for adequate cooking performance precluded simultaneous upper and lower element operation due to the aforementioned current draw limitations. Until the present invention, alternating energizing of full 110-volt amperage capacity upper and lower cooking elements was necessary to afford adequate cooking performance and preheating times. An early example of this type of alternating cooking cycle oven was the two-stage microwave and radiant cooking technology employed by Raymond L. Dills, U.S. Pat. No. 4,188,520. Dills invention was an attempt to provide browning which microwave cooking alone cannot produce. The first cooking stage was solely microwave cooking and a second stage utilized an electric resistance coil to provide browning. This two-stage approach was further improved by Hurko et al., U.S. Pat. No. 4,242,554. Hurko's oven used a multiple alternation between microwave cooking and radiant cooking. This apparently afforded improved browning performance and purportedly created end products that are more consistent with conventional oven performance. The ideal behind the alternating cooking cycles in Hurko's invention was to create an oven whose current draw was reduced to meet ULI requirements for common household 110-volt service of no more than a total of 1550 watts and 13.5 steady state amperage draw. The advent of the small, portable convection oven includes Milton H. Farber, U.S. Pat. No. 3,828,760 wherein the cyclonic affect of heated fan driven convective air for rapid cooking was well demonstrated. Farber's convection oven, however, did not anticipate the conductive cooking possibility of utilizing a refractory, conductive cooking surface in conjunction with convection nor the thermal efficiencies as synergistically optimized in the present invention.

More recently, however, within the art, Victor R. Boddy, U.S. Pat. No. 5,695,668, utilized a similar two-stage cooking approach to Dills invention by introducing a portable conduction/convection oven with a conductive cooking slab. Boddy's oven afforded the same ability to produce foods with the rapidity of convective cooking but combined with the Hurko oven's capability to utilize a 110-volt circuit successfully. Boddy's two-stage cooking approach involved a preheating first stage to heat a high thermal mass refractory slab for conductive cooking. A conductive cooking second stage, wherein the lower element was de-energized and a convection fan and/or the upper element are activated during the actual cooking cycle was then employed. While Boddy's invention seems to provide a workable 110-volt service convection/conduction oven, there are several disadvantages inherent with that oven.

In order to maintain a stable cooking slab temperature, it is implied in Boddy's invention that a slab with a high thermal mass must be used in order to reduce the rate of heat loss. This is so because of Boddy's two-stage cooking process wherein the lower element that preheats this slab is turned off during the second stage wherein the upper elements are energized for cooking. In Boddy's invention, the preferred embodiment includes a refractory slab that is 1-½" thick and weighing 10 to 15 pounds. Since it is a thermal property that the greater the thermal-mass the slower the rate of heat gain and loss, the inverse is also understood (i.e. that the less the thermal-mass the more rapidly heat gain and loss occurs.) Further, it is common knowledge within the art that the consistency in the quality of baked goods produced by conductive cooking is directly related to the stability and even temperature of the cooking surface. By selectively heating the slab from beneath and then de-activating the element beneath the slab, the temperature of a slab of any thermal mass will inevitably decline. It is common knowledge within the art that stable conductive cooking surface temperatures are desirable so this occurrence in Boddy's slab is not desirable. The rate of slab temperature drop will be only partially offset by the small amount of radiant and convective heat provided from above that has contact with the bare upper slab surface. Most of this upper element source energy is absorbed by the foods being cooked. The rate of slab temperature drop is further influenced by the degree of temperature difference between the slab's temperature setting and the convective oven temperature setting. The rate of slab temperature drop is further accelerated if cold or frozen foods are placed on the slab. This is so since, in either situation whether heating air, slab or food, the rate of enthalpy is proportional to the temperature difference of the media involved. To reiterate, three primary problems exist with using Boddy's high thermal mass slab.

First, by using a high thermal mass conductive cooking slat, the rapid temperature drop desired when cooking puff pastries is not possible. Preparing puff pastry is a two stage cooking process. The first stage involves a high temperature of usually 425 to 450 degrees F. The second stage involves a lower temperature of usually 350 degrees F. Therefore, Boddy's high thermal mass slab with it's slow temperature drop is not feasible for cooking puff pastry. However, the use of a low thermal mass slab, as described il the present invention, is desirable.

Secondly, the use of a high-density slab makes the oven unnecessarily heavy. An improvement afforded in the present invention resolves this as will be elaborated below. The slab material costs and the cost to ship a heavier oven will cause the resulting retail price to be higher and/or profit margins to be smaller in order to compete in this market. Further, the difficulty in carrying and installing under counter or cabinet is also increased unnecessarily.

A third disadvantage of using a high-density slab is that preheat times are excessive making the oven thermally inefficient. Boddy's preferred embodiment indicated that initial preheating takes approximately one hour. While this preheating time is shorter than for some large brick pizza ovens in the prior art for commercial usage, it is unacceptable for a consumer oven. The deficiencies of the less relevant prior art are listed below.

Ishammar, U.S. Pat. No. 4,010,341 shows a hot air oven with an air circulating fan, a heater and circulation passages but also does not anticipate conductive cooking slab capabilities nor the thermal efficiencies as synergistically optimized in the present invention.

Vogt, U.S. Pat. No. 4,068,572 shows an apparatus for heating food using a horizontally displayed fan, but also does not anticipate conductive cooking slab capabilities nor the thermal efficiencies as synergistically optimized in the present invention.

Riccio, U.S. Pat. No. 5,605,092 while anticipating an oven with a stone covered bottom and supplemental heater, represents a heavy, high density, brick commercial type oven but does not anticipate the thermal efficiencies as synergistically optimized in the present invention.

Llodra, Jr. et al., U.S. Pat. No. 6,041,769 shows a portable brick oven with an arrangement of bricks and allows for convective/conductive heating. However this oven uses natural gas or propane, which is not as commonly available as the 110-volt electrical service used by the present invention nor does it anticipate the thermal efficiencies as synergistically optimized in the present invention.

McKee, et al., U.S. Pat. No. 6,060,701 shows a compact quick-cooking, conventional oven. While this oven utilizes a cyclonic vortex hot airflow convective cooking system, it represents a different air flow path than the present invention, and moreover, does not anticipate conductive cooking slab capabilities nor the thermal efficiencies as synergistically optimized in the present invention.

Beyond the improvements introduced to this field by the aforementioned prior art, as yet, the art has not seen a lightweight, thermally efficient portable 110-volt capable oven that affords effective cooking performance, using lower cumulative wattage elements without requiring an alternating cooking cycle with its resulting slab temperature fluctuations. The present invention solves these disadvantages while affording several new and significant improvements in energy efficiency, improved cooking versatility and end product quality. It should be noted that the present invention does not preclude the possibility of a 240-volt oven that incorporates the thermal efficiency improvements as applied to a 110-volt oven. As either oven would benefit from the thermal efficiency improvements of the present invention.

The current invention's 110-volt, preferred embodiment can cook all foods conventionally baked in small portable ovens in about 25% to 33% of the packaged oven time indicated, using just a total of 1400 watts. The use of (2) 350 watt elements for radiant and convective cooking within the cooking chamber and (2) 350 watt elements below the conductive cooking slab in conjunction with other collective thermal efficiency improvements elaborated below make this possible. Since the cumulative wattage of the present invention is below the 1550 watt UL, limit for a 110-volt service, simultaneous operation of the upper and lower elements is now possible without sacrificing cooking performance, exceptional cooking and preheating times and while affording exceptional energy savings.

SUMMARY OF THE INVENTION

The present invention, in its preferred embodiment, is a portable, thermally efficient, low voltage, conduction/convection oven that successfully overcomes the foregoing disadvantages of the prior art by means of the following benefits;

(a) a portable or permanently affixed oven whose lower heating elements are shielded and are of a lower wattage, allowing a closer element location to the lightweight conductive cooking slab without cracking it due to thermal shock;

(b) a portable or permanently affixed oven whose lower element shields' inner lower surfaces are anodized to a gold metallic hue, fabricated of brass, brass plated or otherwise colored to this hue, reflecting infrared radiation from the lower elements in a widely distributed pattern. This finish causes reflection of he infrared radiation energy from being absorbed into the shields, reducing their temperature. This in turn reduces the concentrated radiant heat emission from the top of the shields from entering the lightweight conductive cooking slab, further reducing the possibility of thermal shock cracking;

(c) a portable or permanently affixed oven whose lower element shields' inner lower surfaces' wide distribution pattern provides an even infrared radiation distribution to be cast off the lower element chamber's surface and further reflected upwards into the conductive cooking slab's lower surface. This even distribution affords a uniform heating of the conductive cooking slab for optimal cooking performance and reduced thermal shock cracking potential during the preheat cycle;

(d) a portable or permanently affixed oven whose closer element location to the lightweight conductive cooking slab allows the lower element compartment to have a reduced depth, reducing the overall oven height by 2" to 3" over a chamber operating with a cumulative 1550 watts of lower element capacity. This allows the oven to be lower profile for feasible tight under counter and under cabinet installations;

(e) a thermally efficient, portable or permanently affixed oven whose cumulative upper and lower element wattages total less than the 1550 watts and 13.5 steady state amperage draw UL, limits for a 110-volt circuit yet still affords exceptional preheating times, cooking times and performance with all the traditional varieties of foods cooked in portable ovens;

(f) a portable or permanently affixed oven whose lower watage upper cooking elements allow the cooking chamber height to be reduced, causing foods to be located closer to these elements without scorching the foods;

(g) a portable or permanently affixed oven whose reduced cooking chamber height and resulting reduced chamber volume also reduces preheating lime and cooking times with resulting energy savings:

(h) a portable or permanently affixed oven whose reduced cooking chamber height enables the overall oven height to be further reduced to a low profile oven for easier installation in tight under counter or under cabinet applications.

(i) a portable or permanently affixed oven whose minimum slab thickness of ¼" to maximum ⅝" is lighter, weighing approx. 4 to 7 pounds, thus reducing the slab's weight 6 to 11 pounds below the slab in the preferred embodiment of Boddy's oven. This lighter weight slab has reduced material costs, reduces overall oven shipping costs and makes the oven easier to carry and install in tight under counter or under cabinet installations.

(j) a portable or permanently affixed oven whose low thermal mass conductive cooking slab requires as little as 4 to 7 minutes to preheat dependent the specific slab thickness used and upon actual voltage service to the appliance between the normal 105 volt to 120 volt range, using less energy;

(k) a portable or permanently affixed oven whose low thermal mass conductive cooking slab temperature is maintained optimally stable by the constant operation of its lower heating element(s) during conductive cooking uses. This stable conductive cooking surface temperature affords superior cooking results as is commonly recognized in the art;

(l) a portable or permanently affixed oven whose low thermal mass conductive cooking slab temperature drops quickly when desired for the high to low temperature, two stage cooking cycle inherent when preparing of puff pastry;

(m) a portable or permanently affixed oven whose thermal glass front door is sloped backwards from the lower edge, affording greatly improved visibility within the oven, improved convective heat deflection downward toward the food and a reduced cooking chamber volume for reduced preheating times, reduced cooking times and resulting energy savings;

(n) a portable or permanently affixed oven whose back wall 7 is also sloped forward from the bottom edge, affording improved convective heat deflection downward toward the food and a reduced cooking chamber volume for reduced preheating time, reduced cooking times and resulting energy savings;

(o) a portable or permanently affixed oven whose upper cooking chamber wall is anodized to a gold metallic hue, fabricated of brass, brass plated or otherwise colored to this hue in order to optimize the reflection of infrared heat and further improved thermal efficiency. This optimal infrared heat deflection affords significantly improved deep cooking performance, particularly of raw dough baked goods using the lower wattage, upper elements;

(p) a portable or permanently affixed oven whose upper cooking elements are located below the convective, lateral air flow plane of the convection fan. This lower lateral air flow, which occurs near the top of the oven's cooking chamber, prevents these lower wattage elements from becoming excessively cooled, improving their infra-red heating output and resulting infra-red penetrative cooking benefits;

(q) a thermally efficient portable or permanently affixed oven whose upper cooking elements' closer relative position to the upper surface 20 within the cooking chamber, affords optimal infrared output intensity and even infrared reflective distribution. This improvement further enhances infrared and radiant cooking effectiveness using the aforementioned lower wattage elements;

(r) a thermally efficient portable or permanently affixed oven whose upper surface 34 of the lower pan 33 is also anodized to a gold metallic hue, fabricated of brass, brass plated or otherwise colored to this hue in order to optimize the reflection of infrared radiation and further improved thermal efficiency. This affords greater infrared reflection for accelerated preheating of the conductive cooking slab 6 and resulting energy savings;

(s) a thermally efficient portable or permanently affixed oven whose lower surface 19 of conductive cooking slab 6 is finished black in color, creating a "black body" for optimized slab infrared radiation absorption. This improvement further reduces preheating time and affords additional energy savings;

(t) a portable or permanently affixed oven whose control means programmability can provide variable and multiple combinations of heating lenient temperature modulation and convection fan operation and/or speed to optimize energy efficiency, improve cooking versatility and the quality of food end products cooked within it using traditional ICL circuit programming;

(u) a portable or permanently affixed oven designed to operate at 240-volts that incorporates the aforementioned thermally efficient modifications described above.

DETAILED DESCRIPTION OF PREFERRED EMBODIMENT

Figure 1:
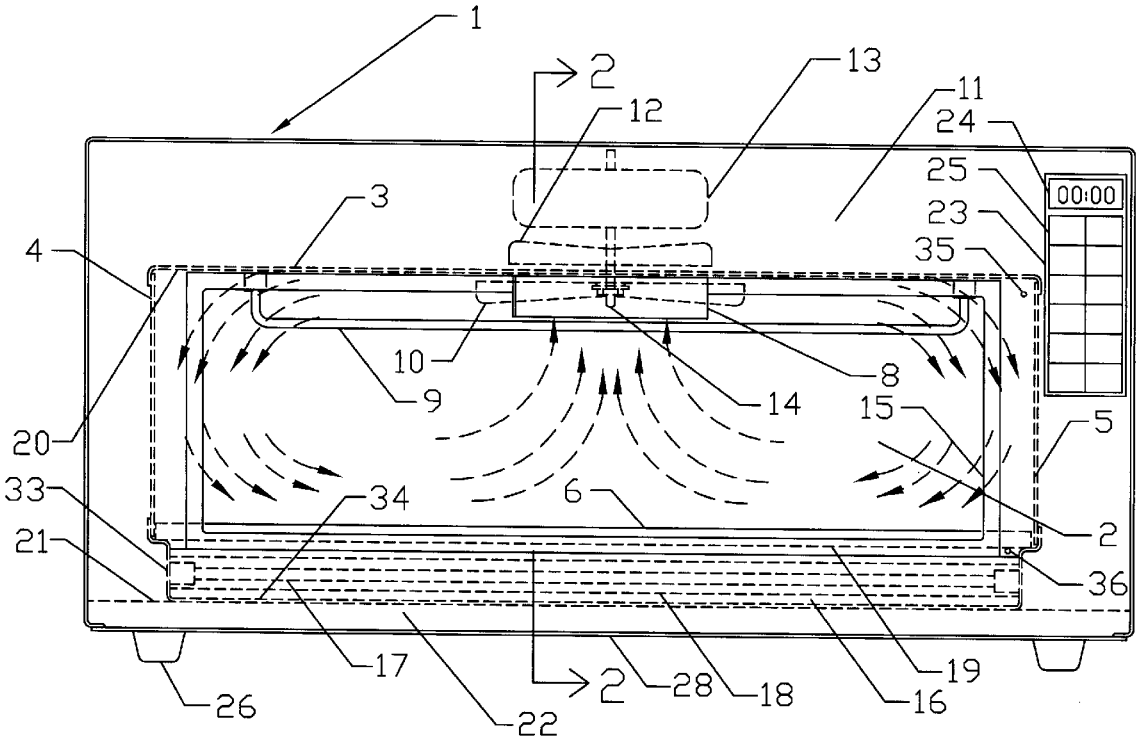
FIG. 1 is a front elevation view thereof.
Figure 2:
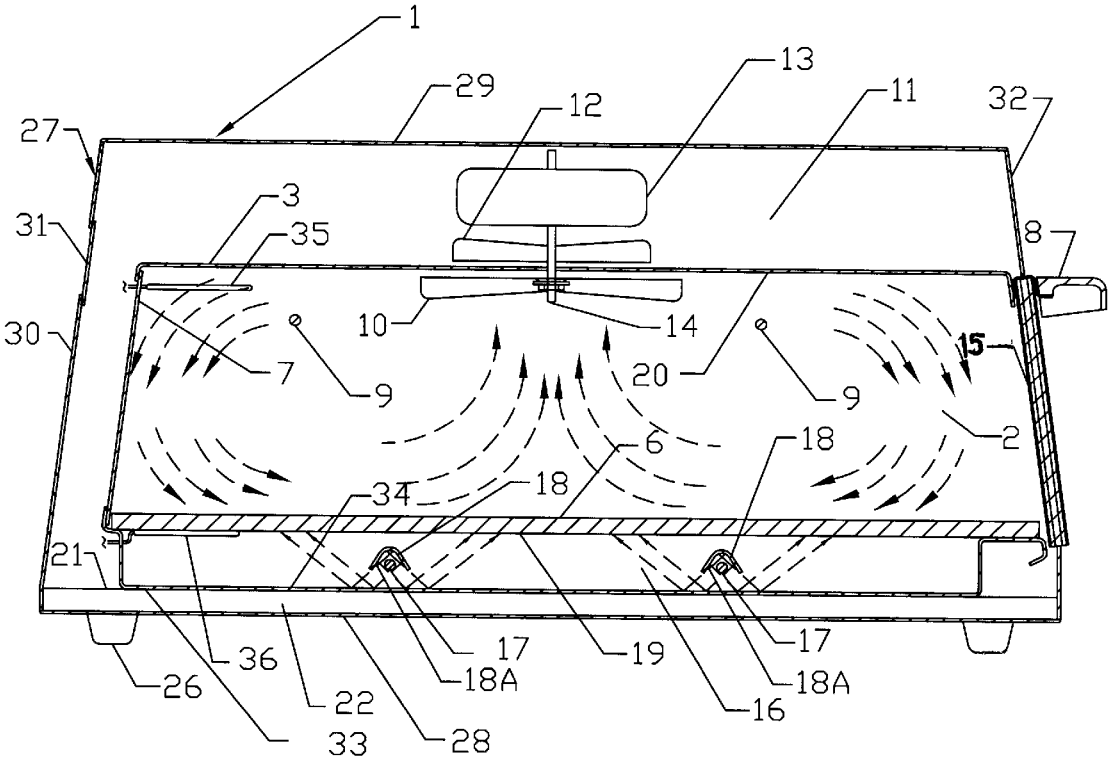
FIG. 2 is a section view taken of FIG. 1 thereof.

Certain terminology is used herein for convenience only and is not to be taken as a limitation on the present invention. Referring to FIGS. 1 and 2, FIG. 1 shows a front view of the thermally efficient portable oven 1. The oven has a cooking chamber 2 comprised of an upper wall 3, sidewalls 4 and 5, conductive cooking slab 6, back wall 7, front panel 32 and door 15. Door 15 has a handle 8 used to open the oven. A thermostat whose temperature probe 35 is located in the cooking chamber 2 controls the chamber's cooking temperature. Conductive cooking slab 6 has a lower surface 19 that may be high temperature paint finished black, creating a "black body" for optimal infrared absorption. The lower surface 20 of upper wall 3 has a golden metallic hue surface for optimal reflection of infrared radiation from upper elements 9. The conductive cooking slab 6, is comprised of stone, ceramic, cordierite or other appropriate materials currently in common use for this purpose. Conductive cooking slab 6 is also removable, able to be slid forward out from the opening of door 15 for cleaning or replacement. The thickness of conductive cooking slab 6 in the preferred embodiment for either a 110-volt or 240-volt oven is ⅜" thick affording, the best balance between shortened preheat time, quick temperature ramp-down time when cooking puff pastry, resistance to thermal shocking and adequate overall durability. In the preferred embodiment conductive cooking slab 6 measures 14"×14", sized to accommodate a medium 13" pizza. However, an enlarged oven chamber design could be made with a conductive cooking slab 6 measuring 17"×17", large enough to accommodate a large 16" pizza. Cumulative wattages of the two upper elements 9 and two lower elements 17 allow for their simultaneous and continuous operation using a 110-volt circuit. In the preferred embodiment for a 110-volt oven, each of the four elements are 350 watts for a cumulative 1400 watts. However, element wattages as low as (4) @225 watts up to the 110-volt limit of approximately (4) @ 390 watts can be used successfully. For a 240-volt service oven, the capacities listed above would be doubled. That being the cumulative wattage of upper and lower elements would be 2800 watts with (4) 700 watts element. Element wattage s as low as (4) @ 450 watts up the 240-volt limit of approximately (4) @ 780 watts can be used successfully. The elements may be cal-rod or quartz or aluminum. The door 15 and front panel 32 are sloped backward from the bottom vertical plane of the over 4.5 degrees in the preferred embodiment, however, sloping as much as 45 degrees may be made without creating significant detriment to the door's and panel's downward air deflection performance. A slope in excess of 45 degrees places the door in a more horizontal than vertical orientation. This orientation reduces visibiliet increases upward flowing heat losses through the glass and creates less than optimal downward convective air deflection. The back wall 7 is also sloped forward from the bottom vertical plane of the oven 4.5 degrees with a similar 45 degree maximum slope recommendation in order to prevent detriment to the downward deflection of convective air. A convection fan 10 is located approximately centered in the upper wall 3 of the oven for even air distribution. The centerline of upper elements 9 are located below the horizontal airflow from convection fan 10 approximately ½" below the lower edge of the fan's blade in the preferred embodiment for a 110-volt oven. This distance could be reduced to as little as ⅛" to as much as 1" below the lower edge of fan 10. This clearance issue is less critical with a 240-volt oven, but good thermally efficient practice would warrant adherence to this principle regardless of the voltage. The balance between optimizing the infrared reflecting performance off the upper surface 20 and overall oven height to allow adequate clearance for taller foods cooked must be considered. To increase the clearance in the later case also increases the overall oven height, which is not optimal for creating a low profile oven for under counter and under cabinet installations which is an object of the present invention. Since the intensity of infrared radiation reduces by the square of the distance, it is desirable to have the heating elements located closer rather than farther from the upper surface 20 with either voltage oven. Although a loser oriented upper elements 9 location puts the elements and their direct infrared radiation closer to the foods, the infrared distribution is more even as reflected from the upper surface 20 than from the lineal radiation distribution of upper elements 9 and is, therefore, preferable. Upper surface 20, which is metallic gold tone by means of anodizing, brass plating or other process, acts as an infrared mirror to provide a uniform distribution of the elements otherwise linearly distributed infrared radiation source. The improvement of adding this gold metallic hue to upper surface 20 reduced preheating tire to 400 degrees F. by over 1 minute for a 110-volt oven and over 2 minutes for a 240-volt oven. In like manner, cooking cycle times were also reduced by over one minute for a 110-volt oven and by over 2 minutes for a 240-volt oven. These times were obtained in side by side testing with an identical oven without this finish. To lower the location of the upper elements 9 beyond 1" for a 110-volt oven, while increasing the direct infrared from the elements into the food, reduces the intensity of the preferably even infrared distribution from upper surface 20. The optimal cooking chamber 2 height, measured from the upper surface of conductive cooking slab 6 to the lower surface of upper elements 9 is 4" for a 110-volt oven, and is thus large enough to accommodate taller foods. However, dependent upon the actual wattage of elements chosen within the disclosed element wattage range above, this distance could be as low as 3.5" to as high as 6" corresponding to the lowest and highest wattage ranges respectively for a 110-volt oven. As would be expected, a clearance of 12" to as high as high as 16" would be warranted when using the higher wattage elements of a 240-volt oven. The infrared cooking performance is critical to this oven, particularly for the lower wattage, 110-volt oven, in that it affords the deep cooking affect, similar to microwave cooking. These infrared enhancements partially compensate for the lower wattage of the present invention's 110-volt, upper elements 9 & lower elements 17, affording disproportionately shortened cooking times and deep cooking ability for the actual wattages required. The deep cooking affect of infrared radiation is of particular benefit for successful preparation of raw dough baked goods using the present invention's lower wattage, 110-volt upper elements 9. The importance of locating the upper elements 9 closer to upper surface 20 is further emphasized by the fact that these elements are lower wattage, 110-volt elements as described above. These elements' infrared output is lower by reason of infrared output being a function of the temperature and input voltage of the elements. Again, this consideration is less critical for a 240-volt oven, however, good thermally efficient design practice would warrant adherence to this principle regardless of the voltage. An upper chamber 11 is formed between the outer assembly 27 and the aforementioned parts of the cooking chamber, sized adequately to accommodate the motor 10 and cooling fan 12. Within upper chamber 11 is located convection fan motor 13 cooling fan 12 and shaft 14 which drives both cooling fan 12 and convection fan 10. Upper chamber 11 also contains electrical wiring not shown. In the preferred embodiment for either 110-volts or 240-volts, fan motor 13 is a constant speed, 1000 rpm, high temperature motor, however, a variable speed, high temperature motor may also be used for additional crisping control. The front panel 32 contains a touch controller 23 containing keypads 25 and timer/clock 24. Touch controller 23 is shown as an electronic controller in the preferred embodiment, designed to be used with an ICL program. However, independent timers, fan switches and temperature indicator lights could also be used. Below conductive cooking slab 6 is lower element chamber 16. Lower pan 33 contains lower elements 17, lower element chamber 16, element shields 18 and lower slab temperature probe 35. Temperature probe 35 is located adjacent to conductive cooking slab 6 and is used to control its temperature. By using low wattage, lower elements 17 and element shields 18, the depth of lower element chamber 16 may be reduced by 2" to 3" over that required when using fill 110 volt capacity, 1550 cumulative wattage lower elements. Lower element chamber 16 may be reduced by 1" to 3" over that required using full 240-volt capacity, 3100 cumulative wattage elements. The use of low wattage, lower elements 17 with lower element shields 18 prevents thermal shock cracking of the low thermal mass conductive cooking slab 6. The lower edges of shields 18 should not be located appreciably lower than the centerline of lower elements 17, as the intent is to redirect the upward directed infrared radiation downward away from conductive cooking slab 6. The lower halves of elements 17 provide lateral and downwardly directed infrared radiation and do not require the deflection required by the upper halves of lower elements 17. The depth of element chamber 16 in the preferred embodiment is 1" deep for a 110-volt oven and 3" deep for a 240-volt oven. However a depth as little as ¾" to as much as 2" can be utilized for a 110-volt oven with varying preheating time results and should be adjusted to accommodate the possible wattage ranges disclosed above. Similarly, lower element chamber 16 height for a 240-volt oven must be increased as the wattages for lower elements 17 increase for that oven in order to mitigate thermal shock cracking of the low thermal mass conductive cooking slab 6. In order to optimize the oven's overall height to a low profile, it is desirable to keep this lower element chamber 16 height to a minimum. It should be noted that from a low profile installation consideration, the 110-volt oven option is a preferable choice for design. However, from a faster preheating and cooking rate perspective, the 240-volt oven is a preferable design choice. In either instance, significant energy consumption savings from reduced preheating and cooking times can be realized with the thermal efficiencies of the present invention. The optimal height of lower element 17 within lower element chamber 16 should be as follows for either a 110-volt or 240-volt oven. The centerline of lower elements 17 should not be located appreciably lower than at mid height of lower element chamber 16. Lower elements 17 could be located as high as within ¼" from the lower surface 19 of the conductive cooking slab 6 as measured from the top of shields 18 for a 110-volt oven. This distance, however, should be located no closer than ¾" for the same clearance on a 240-volt oven. The higher that lower elements 17 are located above the upper surface 34 of lower pan 33, the broader the distribution of reflected infrared radiation onto upper surface 34 and upwards to lower surface 19 of conductive cooking slab 6. This infrared refection from shields 18 and subsequent reflective distribution to lower surface 19 of conductive cooking slab 6 is illustrated with infrared directional flow arrows in FIG. 2. To locate shields 18 closer to the lower surface 19 of conductive cooking slab 6 is to increase the heat conduction potential from shields 18 into conductive cooking slab 6. This also increases the thermal shock cracking potential. This potential is greatest early in the preheating cycle when the slab is cold. This propensity for cracking is even greater when using the higher wattage elements on a 240-volt oven. This shallow lower element chamber 16 allows oven 1 to be of lower profile, fitting more readily in tight under counter or under cabinetry installations especially for the 110-volt oven. The shallow depth of lower element chamber 16 further enhances the thermal efficiency of the oven in that the temperature rises faster in this chamber and consequently of conductive cooking slab 6. This 1" shallow depth of element chamber 16 for the 110-volt oven reduces the preheat time by over one minute. FIG. 2 shows a section of the oven as shown in FIG. 1 and illustrates the uniquely sloped front panel 32 that contains door 15 and also houses touch controller 23 with timer/clock 24 and keypads 25. Also indicated in FIG. 2 is the rear panel 30 that houses vent screen 31. Vent screen 31 provides for the free inlet and outlet of ambient air used to cool upper chamber 11. The inverted "V" shaped element shields 18 can be better seen in FIG. 2. The inner surface 18A of element shields 18 are also gold hue anodized or otherwise tinted to optimize their downward reflection of infrared radiation from lower elements 17. This gold hue tinting reflects infrared radiant heat away from shields 18 rather than allowing it to be absorbed into them. This prevents the shields 18 from becoming excessively hot during the early and most critical stages of the preheating cycle when thermal shock cracking of the conductive cooking slab 6 is most likely to occur as stated previously. Cracking is prevented because the reflection of infrared radiation from shields 18 rather than its absorption reduces their temperature early on in the preheating cycle. This further reduces the linear heat concentration radiated from the top of shields 18 from being conducted into the conductive cooking slab 6. This reduced temperature difference between the shields 18 and slab 6 reduces the resulting thermal shock cracking potential. Upper surface 34 may be similarly gold hue anodized or otherwise tinted for an increased and optimally even reflection of infrared radiation from lower elements 17 and shields 18 upwards against the lower surface 19 of conductive cooking slab 6. By increasing the distance the infrared radiation must travel before reaching conductive cooking slab 6, the resulting magnitude is decreased that contacts the slab. This diminished, indirect and even reflection of this infrared radiation prevents the otherwise concentrated radiation from lower elements 17 from cracking the low thermal mass conductive cooking slab 6. These features are particularly important when incorporating the shallow depth in lower element chamber 16 and when applied to a 240-volt oven where the infrared intensities are much greater. As an alternative approach to using lower wattage, lower elements 17, conductive cooking slab 6 thickness could be increased to ½" to ⅝" and/or the distance from lower elements 17 to lower surface 19 could be increased. However cracking potential is mitigated, the former option is preferable in that neither additional weight nor height is added to the oven and because a low-profiled, lightweight oven with optimal thermal efficiency is an object of the present invention for either 110-volt or 240-volt ovens. It should be reiterated, however, that the 110-volt option lends itself best to the objective of creating a low-profile oven. This is evident, as the clearance information disclosed above substantiates, that the magnitude of clearances and consequent overall height increase of oven 1 must be made for a successful application of these improvements for a 240-volt oven. FIG. 2 most clearly illustrates outer assembly 27. This assembly, comprising of parts listed from top to bottom, and includes, cover panel 29, rear panel 30 that includes vent screen 31, front panel 32, lower panel 28 and base supports 26 located near each corner of lower panel 28. Between lower pan 33 and the lower panel 28 is insulation pan 21 that contains one or more layers of a high-density insulation 22 to contain the heat for safety and greater energy efficiency.

It is to be understood that the form of the invention herein shown and described is to be taken as a preferred example of the same, and that various changes in the shape, size, materials and arrangements of parts may be resorted to without departing from the spirit of the invention or the scope of the appended claims. Many other variations are possible. For example the lower surface 19 may be the natural color of the slab material rather than colored to a "black body" finish. The lower surface 20 of upper wall 3 may be of natural metallic color rather than gold hue colored without serious detriment to the overall oven performance. All interior chamber 2 surfaces (i.e.—side walls 4 & 5 and back wall 7) could also be gold hue anodized, composed of brass, brass plated or otherwise colored to a gold metallic hue. Door 15 and back wall 7 could be in a vertical orientation, with the addition of separate air deflection panels to direct convective air downwards toward the food. A vertically oriented door 15 and front panel 32 could be made taller with more glass surface area to enhance visibility within the oven. A variable speed fan motor could be used in lieu of a constant speed fan. Lower element shields 18 could be semi-circular rather than "V" shaped and could be fabricated of a low conducting, highly reflective material in lieu of metal. The proportional wattage distribution between upper elements 9 and lower elements 17 could also be made.

What is claimed is:

1. A 110-volt service oven comprising;

a) an oven chamber for receiving and cooking foods, b) one or more upper heating elements located in said oven chamber, c) a convection fan located in said oven chamber above said upper heating element(s), d) a low thermal mass conductive cooking, slab located at the bottom of said oven chamber, supporting foods received, e) one or more lower heating elements located below said cooking slab providing constant heating of said cooking slab during conductive cooking uses, f) the cumulative simultaneously energized wattage of said upper elements(s) and said lower element(s) does not exceed UL limits for 110 volt service, which as of this date is limited to a total of 1550 watts and 13.5 steady state amperage draw, g) a power supply for delivering power to said upper element(s), said lower element(s) or both as required for the unique cooking requirements of diverse foods prepared, h) a cooking chamber temperature probe and a conductive cooking slab temperature probe that are connected to a thermostat for independent monitoring and control of said oven chamber and said conductive cooking slab temperatures.

2. The oven of claim 1 wherein said cooking chamber has an upper wall whose lower surface is gold anodized, brass, brass plated or otherwise colored to a gold metallic hue for optimal infrared reflection.

3. The oven of claim 1 wherein a lower pan is located below said lower healing elements, said lower pan having an upper surface that is gold anodized, brass, brass plated or otherwise colored to a gold metallic hue for optimal infrared reflection.

4. The oven of claim 1 wherein said cooking chamber has a back wall that is sloped forward from the lower edge in relation to the vertical plane for improved downward convective air deflection.

5. The oven of claim 1 wherein said cooking chamber has a front wall containing a door that are both sloped backward from the lower edge in relation to the vertical plane for improved downward convective air deflection and improved visibility within the oven.

6. The oven of claim 1 wherein said lower heating element(s) have element shield(s) located between said lower heating element(s) and said conductive cooking slab to mitigate thermal shock and afford even reflected distribution of infrared radiation.

7. The oven of claim 1 wherein said element shield(s) have a lower surface facing said lower heating element(s) that arc gold anodized, brass, brass plated or otherwise colored to a gold metallic hue for optimal infrared reflection.

8. The oven of claim 1 wherein said convection fan has a variable speed motor.

9. The oven of claim 1 wherein said conductive cooking slab has a lower surface that is high temperature finished to a black color, creating a "black body" for optimal infrared absorption.

10. The oven of claim 1 wherein said conductive cooking slab is removable through an opening of said door for cleaning or replacement.

11. A 240-volt circuit oven comprising;

a) an oven chamber for receiving and cooking foods, b) one or more upper heating elements located in said oven chamber, c) a convection fan located in said oven chamber above said upper heating element(s), a low thermal mass conductive cooking slab located at the bottom of said oven chamber, supporting foods received, d) one or more lower heating elements located below said cooking slab providing constant heating of said cooking slab during conductive cooking uses, e) a power supply for delivering power to said upper element(s), said lower element(s) or both as required for the unique cooking requirements of diverse foods prepared, f) a cooking chamber temperature probe and a conductive cooking slab temperature probe that are connected to a thermostat for independent monitor rig and control of said oven chamber and said conductive cooking slab temperatures.

12. The oven of claim 11 wherein said cooking chamber has an upper wall whose lower surface is gold anodized, brass, brass plated or otherwise colored to a gold metallic hue for optimal infrared reflection.

13. The oven of claim 11 wherein a lower pan is located below said lower heating elements, said lower pan having an upper surface that is gold anodized, brass, brass plated or otherwise colored to a gold metallic hue for optimal infrared reflection.

14. The oven of claim 11 wherein said cooking chamber has a back wall that is sloped forward from the lower edge in relation to the vertical plane for improved downward convective air deflection.

15. The oven of claim 11 wherein said cooking chamber has a front wall containing a door that are both sloped backward from the lower edge in relation to the vertical plane for improved downward convective air deflection and improved visibility within the oven.

16. The oven of claim 11 wherein said lower heating element(s) have element shield(s) located between said lower heating element(s) and said conductive cooking slab to mitigate thermal shock and afford even reflected distribution of infrared radiation.

17. The oven of claim 11 wherein said element shield(s) have a lower surface facing said lower heating element(s) that are gold anodized, brass, brass plated or otherwise colored to a gold metallic hue for optimal infrared reflection.

18. The oven of claim 11 wherein said convection fan has a variable speed motor.

19. The oven of claim 11 wherein said conductive cooking slab has a lower surface that is high temperature finished to a black color, creating a "black body" for optimal infrared absorption.

20. The oven of claim 11 wherein said conductive cooking slab is removable through an opening of said door for cleaning or replacement.

21. A low profile, thermally efficient oven comprising;

a) a reduced height oven chamber for receiving and cooking foods, b) one or more upper heating elements located in said oven chamber, c) a convection fan located in said oven chamber above said upper heating element(s), d) a low thermal mass conductive cooking slab located at the bottom of said oven chamber, supporting foods received, e) a shallow lower element chamber located below said cooking chamber, f) one or more lower heating elements located within said element chamber providing constant heating of said low thermal mass cooking slab during conductive cooking uses, g) a power supply for delivering power to said upper element(s), said lower element(s) or both as required for the unique cooking requirements of diverse foods prepared, h) a cooking chamber temperature probe and a conductive cooking slab temperature probe that are connected to a thermostat for independent monitoring and control of said oven chamber and said conductive cooking slab temperatures.

22. The oven of claim 21 wherein said cooking chamber has an upper wall whose lower surface is gold anodized, brass, brass plated or otherwise colored to a gold metallic hue for optimal infrared reflection.

23. The oven of claim 21 wherein a lower pan is located below said lower heating elements, said lower pan having an upper surface that is gold anodized, brass, brass plated or otherwise colored to a gold metallic hue for optimal infrared reflection.

24. The oven of claim 21 wherein said cooking chamber has a back wall that is sloped forward from the lower edge in relation to the vertical plane for improved downward convective air deflection.

25. The oven of claim 21 wherein said cooking chamber has a front wall containing a door that are both sloped backward from the lower edge in relation to the vertical plane for improved downward convective air deflection and improved visibility within the oven.

26. The oven of claim 21 wherein said heating element(s) have element shield(s) located between said lower heating element(s) and said conductive cooking slab to mitigate thermal shock and afford even reflected distribution of infrared radiation.

27. The oven of claim 21 wherein said element shield(s) have a lower surface facing said lower heating element(s) that are gold anodized, brass, brass plated or otherwise colored to a gold metallic hue for optimal infrared reflection.

28. The oven of claim 21 wherein said convection fan has a variable speed motor.

29. The oven of claim 21 wherein said conductive cooking slab has a lower surface that is high temperature finished to a black color, creating a "black body" for optimal infrared absorption.

30. The oven of claim 21 wherein said conductive cooking slab is removable through an opening of said door for cleaning or replacement.

* * * * *